United States Patent [19]

Bartlett

[11] Patent Number: 5,033,401

[45] Date of Patent: Jul. 23, 1991

[54] GLASS SLIPPER FOR AN INFLATABLE BOAT

[76] Inventor: Ronald C. Bartlett, 1 Pleasant View Dr., Latham, N.Y. 12110

[21] Appl. No.: 493,488

[22] Filed: Mar. 14, 1990

[51] Int. Cl.[5] ..... B63B 7/00

[52] U.S. Cl. ..... 114/343; 114/345; 441/4

[58] Field of Search ..... 114/343, 345, 357; 441/35, 40, 41, 42

[56] References Cited

U.S. PATENT DOCUMENTS

| | | | |
|---|---|---|---|
| 2,683,270 | 7/1954 | Long | 114/345 |
| 3,261,038 | 7/1966 | Klepper | 114/345 |
| 3,451,078 | 6/1969 | Edwards . | |
| 4,498,413 | 2/1985 | Cochran . | |
| 4,545,319 | 10/1985 | Ferronniere et al. | 114/345 |
| 4,660,497 | 4/1987 | Cochran . | |
| 4,750,448 | 6/1988 | Hennebutte | 114/345 |
| 4,779,555 | 10/1988 | Hong | 114/345 |
| 4,858,550 | 8/1989 | Bellia . | |
| 4,928,619 | 5/1990 | Cochran | 114/345 |

*Primary Examiner*—Sherman D. Basinger
*Assistant Examiner*—Stephen P. Avila
*Attorney, Agent, or Firm*—Schmeiser, Morelle & Watts

[57] ABSTRACT

The invention is a removable sub-hull for an inflatable boat. The rear portion of the sub-hull is attached to the boat by straps and the forward portion is attached through the use of a cup shaped portion that receives the bow of the inflatable boat. The sub-hull includes a keel member on its bottom surface and can be used on a variety of different length inflatable boats. The top of the cup portion can either be an extension of the rigid bottom of the sub-hull or, it can be a removable, flexible cover member.

16 Claims, 2 Drawing Sheets

GLASS SLIPPER FOR AN INFLATABLE BOAT

FIELD OF THE INVENTION

The invention is in the field of boat accessories. More specifically, the instant invention is in the field of inflatable boat sub-hulls.

BACKGROUND OF THE INVENTION

Inflatable boats are a popular alternative to rigid hulled boats. Inflatables offer the ability to be easily stored or transported when deflated and an extremely high degree of buoyancy when inflated. They are commonly horseshoe shaped and have either a rigid transom or an additional inflatable portion at the stern. These boats can be used to transport from 1, to in excess of 30 people depending on the boat's size. Inflatable boats are used as weekend craft, dinghies for larger boats or as survival craft such as life rafts.

Typically, an inflatable boat will employ at least two inflatable chambers to form the craft's horseshoe shape and a wooden connecting plank at the rear to form the transom. The bow is formed in the region where the forward ends of the inflatable chambers abut. The bottom of the boat is normally formed from a flexible plastic material whose outer edges are affixed to the inflatable chambers.

Inflatable boats, while providing a number of distinct advantages, suffer from a number of problems inherent to the materials involved and the overall design of the craft.

These boats are normally flat-bottomed and do not have a depending keel due to the flexible nature of the bottom material. Without a keel, these boats have minimal directional stability. This lack of stability is most apparent during turning maneuvers when excessive slippage is normally experienced.

An inflatable boat's air chambers are critical to the safety of the craft, yet they are jeopardized by conditions which the boats commonly experience. Inflatable boats are often beached and thereby are subject to abrasion damage. They are used in shallow or protected waters (bays, harbors, marinas, etc.) where the probability of contacting floating debris is great. The inflatable chambers typically employ at least one layer of flexible material to form the sides of the chamber and most commonly, a multi-layered construction is used. However, due to the inherent flexibility of the materials used, puncture or heavy abrasion of the chambers continues to be a real concern. Floating debris can act like a knife to cut the chamber walls when the craft is traveling at a high speed. Numerous beachings of the boat can eventually wear through the wall material or at least considerably weaken it. Therefore, the integrity of the inflatable chambers is often at risk and concerns for this problem have led substantially every manufacturer to include in their boats a plurality of separate, air filled chambers in lieu of a solitary chamber.

The inherent flexibility of the boat and the materials that make up its water contacting surface leads to another significant problem with this type of craft. A considerable amount of horsepower is required to bring the boat to planing speed. This is due to frictional resistance between the boat's bottom surface and the water, the flexible nature of the boat's bottom which creates a non-planar surface during acceleration and actual bending of the boat. As the outboard engine provides thrust, the bow of the boat lifts and thereby causes the bottom of the front portion of the boat to act as a plow and thereby greatly increase the drag forces on the boat. Besides increasing the power requirements, the above noted factors all adversely affect the fuel economy of the craft.

An additional handling characteristic of inflatable boats that is undesirable is the rough manner in which the bow of the boat cuts a wave. When an inflatable boat is being propelled at even a minimal speed into a wave, its bow tends to break the wave. Most rigid boats have a relatively sharp bow and, upon contacting a wave, the bow cleanly cuts through it. In this way, rigid craft avoid or minimize the considerable shock that can result should the bow not cut the wave. Most inflatable boats have somewhat a "V"-shaped bow, but the front "cutting" edge is blunt at best. When an inflatable boat contacts a wave, the bow poorly cuts the wave and a considerable impact results and is sorely felt by the boat's occupants. In addition, a substantial amount of spray also results during a hard impact further adding to the discomfort of the boat's passengers. The resilient nature of the inflatable chambers further exacerbates the problem since the bow tends to flatten during impact thereby increasing its frotal area and further blunting its cutting ability.

To overcome some of the noted problems with inflatable boats, a number of hybrid boats have been patented. These boats have a traditional rigid bottom and use inflatable chambers as sides. These boats do not enjoy the easy portability and low cost of conventional inflatable boats. Craft of this sort can be seen in the patents issued to Cochran (U.S. Pat. Nos. 4,660,497 and 4,498,413).

In a recent effort to solve the noted problems with inflatable boats, Bellia received a patent (U.S. Pat. No. 4,858,550) for a rigid, keeled bottom that can be attached to an inflatable boat. This device uses straps at its front and back for attaching it to the bow and stern of the inflatable boat. As can be seen in FIG. 5 of the patent, the bow of the inflatable boat rests atop the device and requires the addition of a bow strap retaining means to the inflatable boat. The Bellia rigid bottom also extends the length of the boat and is not adaptable to different length boats.

SUMMARY OF THE INVENTION

The invention is a removable sub-hull for an inflatable boat. It consists of a substantially planar, rigid rear portion and a cup-like forward portion. The forward portion is shaped so that when the sub-hull is attached to an inflatable boat, the forward portion securely retains and internally receives the inflatable boat's bow area. The sub-hull rear portion extends aft of the bow and includes attachment straps for fastening it to the inflatable boat. The straps are located on either the sides or the stern end of the sub-hull's rear portion. Therefore, the straps in combination with the shaped sub-hull forward portion together function to securely attach the sub-hull to an inflatable boat. Unlike the Bellia sub-hull, no forward strap is required.

The sub-hull rear portion includes at least one downwardly extending keel member. This keel member vastly improves the handling and stability of an inflatable boat when the sub-hull is in place.

A smooth, rigid material is used for the sub-hull rear portion and at least the bottom of the sub-hull forward portion. A suitable choice for the material is fiberglass with or without internal reinforcement. This type of material is extremely durable and can be easily formed into a proper shape. The rigid sub-hull, when attached to the inflatable boat, fully protects the relatively more vulnerable inflatable chambers from floating debris and sand abrasion.

An additional advantage provided by the smooth bottom of the sub-hull is a reduction in drag forces when the craft moves through the water. Also, the bottom surface remains planar throughout all speed ranges and conditions. These features increase the overall economy of the craft and lower the required horsepower to achieve planing speed.

The bow or front portion of the sub-hull is shaped to not only receive the inflatable boat's bow, but its exterior surface is shaped to cleanly cut through the water. Its front edge has a true "V"-shape and thereby avoids the harsh impacts that often occur when the blunted bow of most inflatables contacts a wave. Alternatively, the front portion of the sub-hull can be shaped to match the inflatable boat's bow. This simplifies fitting the sub-hull to the boat and also reduces fabrication costs.

An additional feature of interest of the bow portion of the sub-hull is its rearwardly extending top portion. This top portion captures an upper area of the inflatable boat's bow and is disclosed in two embodiments. In the first embodiment, the sub-hull is of unitary construction and the top of the bow portion is made of the same rigid material as the rest of the sub-hull. It should also be noted that the top portion can be made from other rigid materials such as wood or metal. In the second embodiment, the top of the sub-hull's bow portion is made of a flexible, vinyl material and is removable from the rest of the sub-hull. The use of a removable top improves and facilitates stacking, storing and transporting of the sub-hull.

A tube shaped rubber strip can be applied to the perimeter edges of the sub-hull. The strip prevents the edges of the sub-hull from cutting into the inflatable chambers and also acts as a bumper when the boat is tied to a dock or other boat. Alternately, a rubber strip-like cushion can be placed on the inner surface of the sub-hull's edges to prevent cutting of the inflatable chambers.

Lastly, it is pointed out that the sub-hull preferably is sized to extend from the inflatable boat's bow to its transom. However, this full length sub-hull is not required for it to function as described. It must receive the inflatable boat's bow. Its length however, is not required to extend to the inflatable boat's transom. Due to the fact that a strap arrangement retains the rear portion of the sub-hull to the inflatable boat, the sub-hull may extend only two-thirds to one-half of the inflatable boat's length and still be secured in place and function effectively. Therefore, one can provide long straps for the rear sub-hull attachment and the sub-hull can be mounted on a wide variety of different length inflatable boats and still provide significantly improved performance and durability.

DETAILED DESCRIPTION OF THE DRAWINGS

Figure 1:
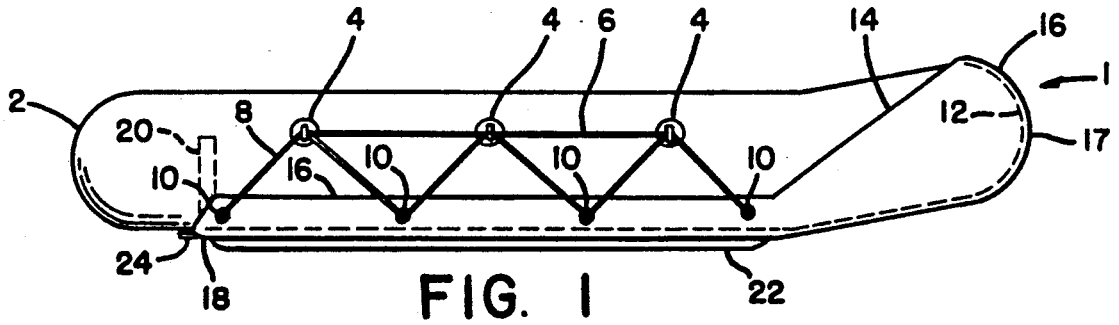
FIG. 1 is a side view of the sub-hull mounted to an inflatable boat.

FIG. 1 is a side view of the sub-hull 1 mounted on an inflatable boat 2. The boat shown includes a number of rings 4 that are commonly used to secure a rope handrail 6. Also attached to the rings 4 is a resilient strap 8 which is fixed to the sub-hull at a number of attachment points 10. Preferably, the strap is fixed at one of its ends to the forward most attachment point. The strap is then threaded as shown through the rings 4 and attachment points 10 and finally, removably secured to the rearward most attachment point using a locking clip or the like.

The inflatable boat's bow section 12 is shown in phantom in FIG. 1. The sub-hull's front portion 14 includes a top portion 16 which extends rearwardly from the furthest forward point 17 of the front portion. The sub-hull's front portion internally receives the bow of the inflatable boat and thereby secures the forward end of the sub-hull to the boat.

The sub-hull rear portion 16 extends beneath the main body of the inflatable boat and is shown with its rear horizontal edge 18 even with the inflatable boat's transom 20 (shown in phantom). Extending along a central area of the sub-hull's rear portion is a keel member 22. The keel member greatly improves the directional stability and drift resistance of the craft.

At the extreme rear edge of the sub-hull can be seen a securing ring 24. The purpose of the securing ring will be later described.

Figure 2:
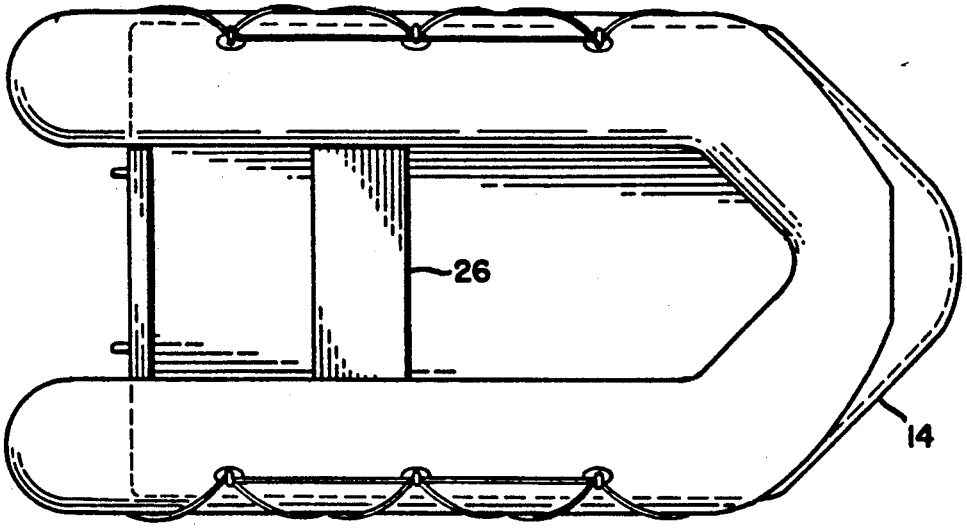
FIG. 2 is a plan view of the boat and sub-hull of FIG. 1.

FIG. 2 shows a plan view of the boat and sub-hull of FIG. 1. In this view, forward portion 14 can be clearly seen as enveloping the bow of the inflatable boat. In this figure is also shown one seat 26 mounted within the inflatable boat.

Figure 3:
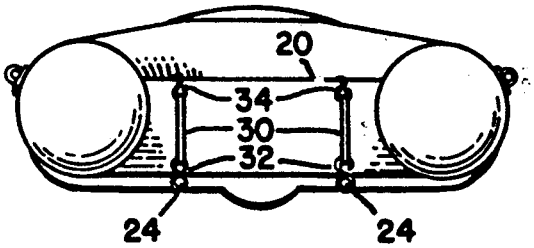
FIG. 3 is a rear view of an inflatable boat and sub-hull showing an alternate location for the mounting straps.

FIG. 3 shows a rear view of the boat and sub-hull of FIG. 1. However, in this view, an alternate rear attachment embodiment is shown. The side straps 8 have been replaced by a pair of transom straps 30. Each strap has a bottom hook 32 which attaches to a ring 24 of the sub-hull and a top hook 34 which attaches to the top of the inflatable boat's transom 20. In this manner, the rear portion of the sub-hull is securely fashioned to the inflatable boat's transom.

Figure 4:
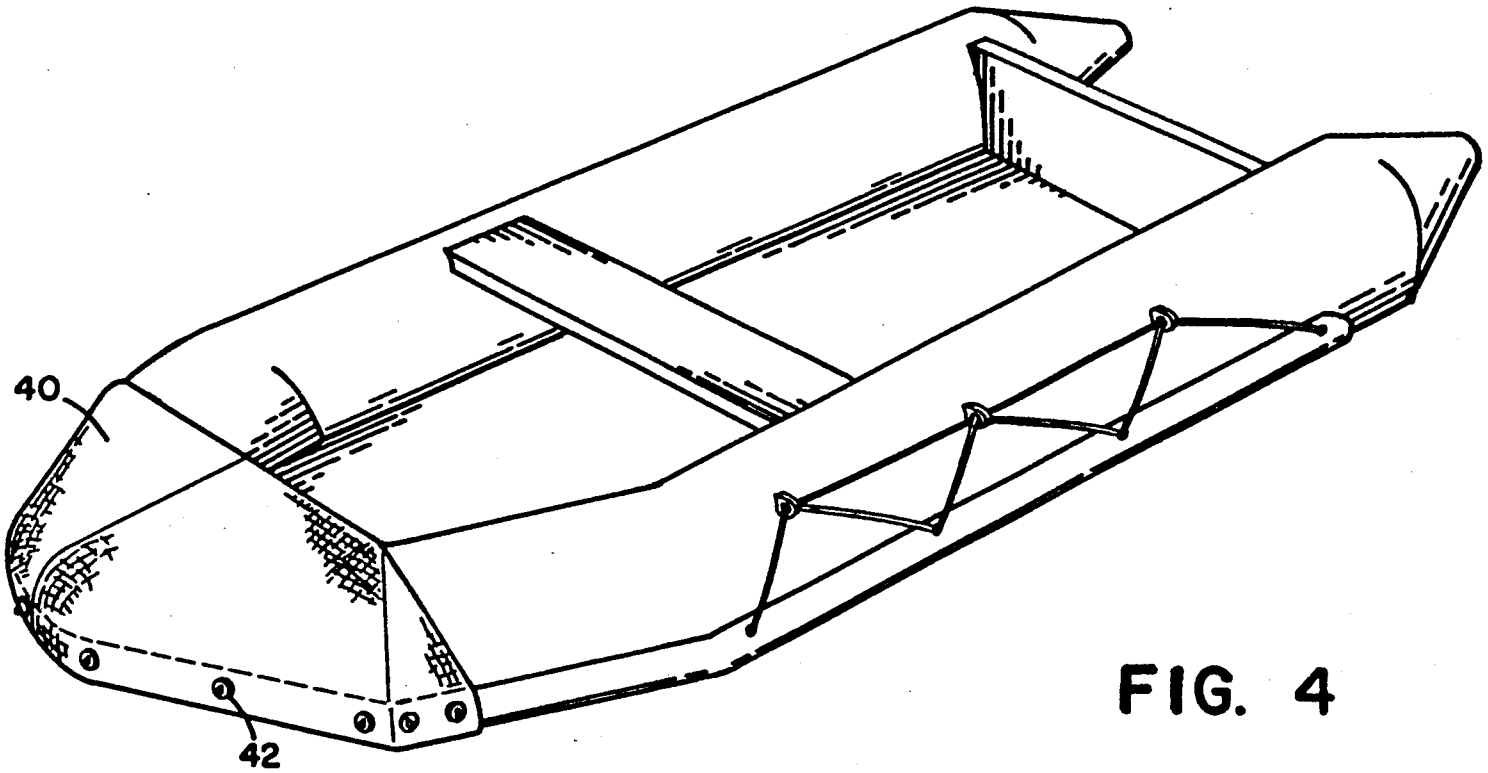
FIG. 4 is a perspective view of an inflatable boat with an attached sub-hull. Shown in this view is an alternate embodiment of the sub-hull's top portion.

FIG. 4 shows a perspective view of an inflatable boat with the sub-hull of the invention in place. In this view, side straps 8 are again shown. However, this view shows a very different embodiment of the front portion of the sub-hull. A flexible, vinyl-type cover 40 is used to form the top portion of the sub-hull's front portion 14. The cover 40 lies atop the bow of the inflatable boat. The outer edge of the cover extends downwardly below the horizontal center line of the inflatable boat. The cover is removably attached to the rigid bottom portion of the sub-hull by snaps 42 or other functionally similar fasteners. While the cover is shown entirely concealing the bow of the inflatable boat, it should be noted that the cover can be trapezoidally shaped and still be functional. In other words, the very front or tip of the cover can be disattached from the mounts 42 and folded back. More simply, the cover 40 can be half the shown length and be in the form of a band that stretches from one side to the other without covering the very tip of the inflatable boat. This band-like cover, in conjunction with the rigid bottom of the sub-hull, forms a cone which receives the bow of the boat and functions to secure the sub-hull to the boat's bow. In addition, the band-like cover can be used in conjunction with and to extend rearwardly from a rigid top portion that extends rearwardly only a short distance. In this way, the combination of the rigid and flexible top portions would provide sufficient internal surface area to secure the boat's bow and still retain many of the advantages provided by having a removable top.

A removable top portion is used for the following reasons. Firstly, the rigid, lower portion of the sub-hull can be easily molded since there are no inwardly extending portions. Secondly, with the cover removed, a plurality of sub-hulls may be stacked one atop the other to facilitate shipping and storage. Thirdly, since the top portion of the sub-hull's forward section is responsible for approximately one-half of the height of the sub-hull, removal of this portion further facilitates its ability to be stored or transported. Finally, since the removable cover can be made from light-weight material its reduces the overall weight of the sub-hull. This makes the sub-hull easier to carry and decreases the power requirements of a boat with the sub-hull attached.

It should be noted that attachment of the instant invention to an inflatable boat is a simple and fast process. The sub-hull is first placed on a flat surface. Then, the boat is placed on top of the sub-hull and pushed forward until its bow is received within the sub-hull's forward portion. Next, the rear straps are attached, and the process is complete. Since, the the bow attachment is uncomplicated, the sub-hull can be attached during adverse conditions or even when the inflatable boat is in the water.

The embodiments disclosed herein have been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A removable sub-hull for an inflatable boat wherein said inflatable boat is of the type having inflatable side members that extend forwardly to form at least a portion of the boat's bow and also having a bottom means that extends between said inflatable side members and forms the bottom of the inflatable boat and wherein said sub-hull comprises:

a substantially flat, rigid rear portion that is sized to at least partially cover a bottom surface of the bottom means of an inflatable boat, said rear portion including a downwardly extending keel means; and a front portion sized to inwardly receive at least a portion of a bow of an inflatable boat, said front portion including a top portion that extends rearwardly and is sized to capture an upper portion of an inflatable boat's bow.

2. The sub-hull of claim 1 wherein the sub-hull includes side portions that extend in an upward direction and thereby can contact an outer portion of an inflatable boat's inflatable side members.

3. The sub-hull of claim 2 also including fastening means located on said side portions of the sub-hull rear portion for attaching the rear portion of the sub-hull to the inflatable boat.

4. The sub-hull of claim 1 also including fastening means located on a rear portion of the sub-hull rear portion for attaching to a rear portion of the inflatable boat.

5. The sub-hull of claim 1 wherein the entire sub-hull is a unitary body.

6. The sub-hull of claim 5 wherein the sub-hull is made of a fiberglass material.

7. The sub-hull of claim 1 wherein the top portion of the sub-hull front portion is fashioned from a flexible material.

8. The sub-hull of claim 7 wherein said top portion of the sub-hull front portion is made of a vinyl material.

9. The sub-hull of claim 1 wherein the top portion of the sub-hull front portion is fashioned from a rigid material.

10. The sub-hull of claim 1 wherein said top portion of the sub-hull front portion is removably fastened to a bottom portion of the sub-hull front portion.

11. The sub-hull of claim 1 wherein the sub-hull is sized so that it substantially covers the entire bottom surface of an inflatable boat.

12. The sub-hull of claim 1 wherein the front portion is shaped so that when the sub-hull is in place on a boat, it will provide the boat with the ability to cut through a wave.

13. A removable sub-hull for an inflatable boat wherein said inflatable boat is of the type having inflatable side members that extend forwardly to form at least a portion of the boat's bow and also having a bottom member that extends between said inflatable side members and forms the bottom of the inflatable boat and wherein said sub-hull consists essentially of:

a substantially flat, rigid rear portion that is sized to at least partially cover a bottom surface of an inflatable boat's bottom member, said rear portion including a downwardly extending keel means; and a front portion sized to inwardly receive at least a portion of a bow of an inflatable boat, said front portion including a top portion that extends rearwardly and is sized to capture an upper portion of an inflatable boat's bow; and a fastening means operatively connected to the sub-hull rear portion for attaching the sub-hull rear portion to a rear portion of an inflatable boat.

14. The device of claim 13 wherein the sub-hull is a unitary body.

15. The device of claim 14 wherein the sub-hull is made of fiberglass.

16. A removable sub-hull in combination with an inflatable boat wherein said inflatable boat is of the type having inflatable side members that extend forwardly to form at least a portion of the boat's bow and also having a bottom member that extends between said inflatable side members and forms the bottom of the inflatable boat and wherein said sub-hull comprises:

a substantially flat, rigid rear portion that is sized to at least partially cover a bottom surface of an inflatable boat wherein said bottom surface extends between the boat's inflatable side members and wherein the rear portion of the sub-hull includes a downwardly extending keel means;

a front portion sized to inwardly receive at least a portion of a bow of the inflatable boat, said front portion including a top portion that extends rearwardly and is sized to capture an upper portion of the inflatable boat's bow; and a fastening means operatively connected to the sub-hull rear portion for attaching the sub-hull rear portion to said inflatable boat.

* * * * *